US006398577B1

(12) United States Patent
Simmel et al.

(10) Patent No.: US 6,398,577 B1
(45) Date of Patent: Jun. 4, 2002

(54) LATCHING/UNLATCHING SYSTEM FOR ELECTRICAL CONNECTORS

(75) Inventors: George M. Simmel, Naperville; Thomas E. Kos, Orland Park, both of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/678,768

(22) Filed: Oct. 4, 2000

(51) Int. Cl.[7] ..... H01R 13/627
(52) U.S. Cl. ..... 439/357; 439/341
(58) Field of Search ..... 439/350, 353, 439/351, 357, 358, 341, 521

(56) References Cited

U.S. PATENT DOCUMENTS

| | | | | |
|---|---|---|---|---|
| 4,089,579 A | | 5/1978 | Steinbach | 339/91 |
| 4,113,337 A | | 9/1978 | McKee | 339/91 |
| 5,021,002 A | | 6/1991 | Noschese | 439/352 |
| 5,052,943 A | | 10/1991 | Davis | 439/357 |
| 5,096,436 A | | 3/1992 | Nosches | 29/876 |
| 5,097,392 A | | 3/1992 | Tanaka et al. | 361/391 |
| 5,387,134 A | | 2/1995 | Bryce et al. | 439/660 |
| 5,518,424 A | | 5/1996 | Douty et al. | 439/660 |
| 5,746,622 A | * | 5/1998 | Consoli et al. | 439/521 |
| 5,855,484 A | | 1/1999 | Hennessey et al. | 439/79 |
| 5,964,601 A | | 10/1999 | Tsurumaru et al. | 439/141 |
| 6,030,249 A | | 2/2000 | Illg | 439/353 |
| 6,042,414 A | | 3/2000 | Kunert | 439/374 |
| 6,068,496 A | | 5/2000 | Penate | 439/140 |
| 6,071,141 A | | 6/2000 | Semmeling et al. | 439/353 |

* cited by examiner

*Primary Examiner*—Gary Paumen
*Assistant Examiner*—Phuongchi Nguyen
(74) *Attorney, Agent, or Firm*—Stephen Z. Weiss

(57) ABSTRACT

An electrical connector assembly includes a first connector having a body mounting a plurality of terminals, with a locking shoulder on the body. A second connector includes a body mounting a plurality of terminals engageable with the terminals of the first connector. The second connector is mateable with the first connector in a given mating direction. A flexible latch arm is mounted on the body of the second connector and includes a latch hook engageable with the locking shoulder of the first connector when the two connectors are mated in the given mating direction. The locking shoulder is located in an open-sided cavity in the body of the first connector to allow the latch hook to be lifted away from the locking shoulder in response to tilting the first connector relative to the second connector transversely of the given mating direction.

11 Claims, 8 Drawing Sheets

LATCHING/UNLATCHING SYSTEM FOR ELECTRICAL CONNECTORS

FIELD OF THE INVENTION

This invention generally relates to the art of electrical connectors and, particularly, to a system for latching and unlatching a pair of mating connectors.

BACKGROUND OF THE INVENTION

A typical electrical connector assembly includes a pair of electrical connectors which are mateable to interengage conductive terminals on the connectors to establish electrical circuits through the connector interface. Each connector typically includes a dielectric housing within which the terminals are mounted. The mating connectors are mateable in a given direction.

Most often, the mating connectors of a connector assembly have some form of latching system to hold the connectors in a mated condition. Sometimes the latching system is releasable to allow for the connectors to be unmated. Just one example is in a holding frame and a portable data entry device. One connector of the connector assembly is mounted on the holding frame, and the other connector of the assembly is mounted on the portable data entry device. The holding frame has what is called a "docking port" for receiving the portable data entry device. It is desirable to provide a secure latching mechanism to hold the portable data entry device in the docking port of the holding frame to maintain the electrical connectors in mated condition. However, the portable data entry device must be able to be easily removed from the docking port of the holding frame, and this creates a dilemma. In other words, a secure latching mechanism requires a given amount of forces to mate the connectors and securely hold the data entry device on the holding frame. On the other hand, these forces often are excessive to overcome in removing the portable data entry device from the docking port of the holding frame. Repeated cycles of use of the device often causes damage to the components because of the excessive forces involved. The present invention is directed to solving these problems by providing a latching system which holds the connectors securely in a mated condition but allows ready release of the connectors with very minimal forces if at all.

SUMMARY OF THE INVENTION

An object, therefore, of the invention is to provide a new and improved latching system between a pair of connectors of an electrical connector assembly.

In the exemplary embodiment of the invention, the connector assembly includes a first connector having a body mounting a plurality of terminals. A locking shoulder is provided on the body. A second connector includes a body mounting a plurality of terminals engageable with the terminals of the first connector. The second connector is mateable with the first connector in a given mating direction. A flexible latch arm is mounted on the body of the second connector and includes a latch hook snappingly engageable with the locking shoulder of the first connector when the two connectors are mated in the given mating direction. The locking shoulder is located in an open-sided cavity in the body of the first connector to allow the latch hook to be lifted away from the locking shoulder in response to tilting the first connector relative to the second connector transversely of the given mating direction.

The invention contemplates that the locking shoulder be located at one side of the cavity in the body of the first connector. The side of the cavity opposite the locking shoulder is open to allow the latch hook to move away from the locking shoulder with little or no unlatching forces.

As disclosed herein, the locking shoulder is formed on a metal component which is insert molded in the body of the first connector. The flexible latch arm is stamped and formed of sheet metal material and is mounted on the body of the second connector. The bodies of the first and second connectors are elongated, with the terminals of the respective connectors in elongated arrays. A pair of the locking shoulders and respective latch arms are spaced longitudinally of the elongated bodies, with one locking shoulder and respective latch arm located outside each opposite end of the elongated arrays of terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
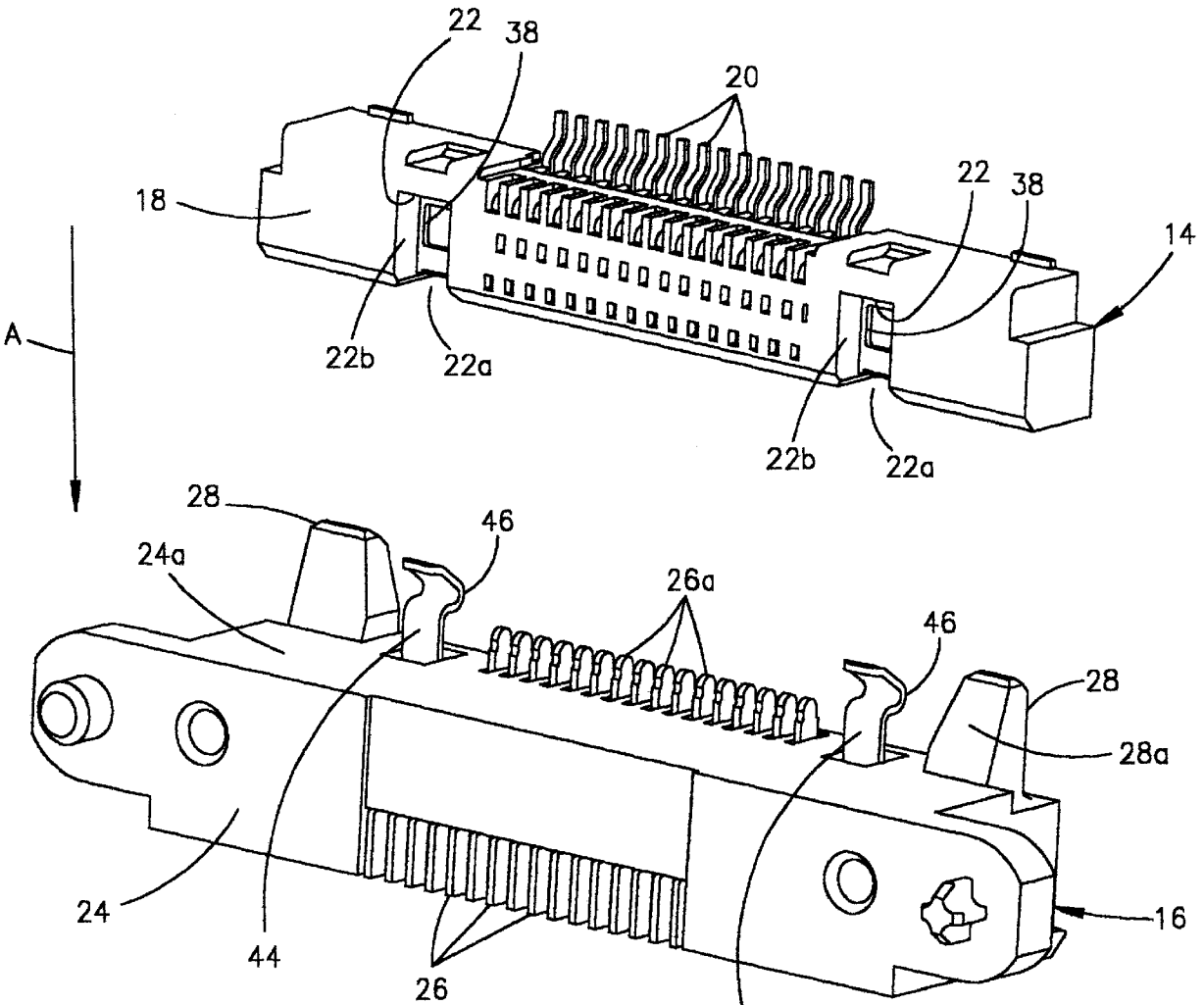
FIG. 1 is a front perspective view of an electrical connector assembly incorporating the concepts of the invention, with the connectors in an unmated condition.
Figure 2:
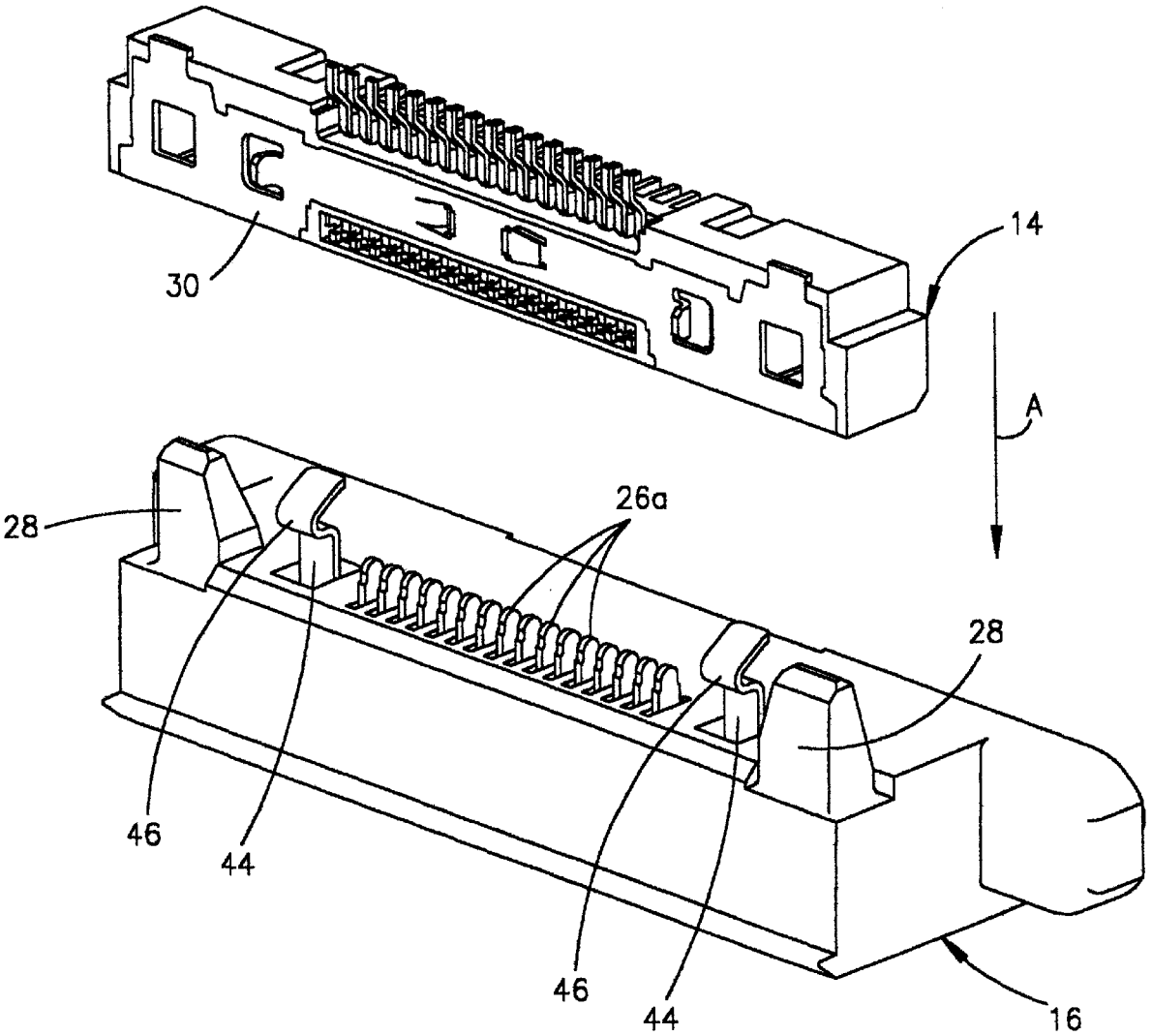
FIG. 2 is a rear perspective view of the connectors in a unmated condition.

Referring to the drawings in greater detail, and first to FIGS. 1 and 2, the invention is embodied in an electrical connector assembly, generally designated 12, which includes a first connector, generally designated 14, which is mateable in the direction of arrows "A" with a second connector, generally designated 16. First connector 14 is of a type used in a portable data entry device, and second connector 16 is of a type used in a docking port of a holding frame for the portable data entry device. However, it should be understood that the invention is not limited to the specific connectors shown nor the specific stated use.

First connector 14 of connector assembly 12 includes an elongated dielectric body 18 which may be molded of plastic material or the like. The body mounts a plurality of terminals 20 in a parallel linear array. The body includes a pair of cavities 22 located outside each opposite end of the parallel linear array of terminals. Each cavity has an open bottom, as at 22*a,* and an open side, as at 22*b.*

Figure 3:
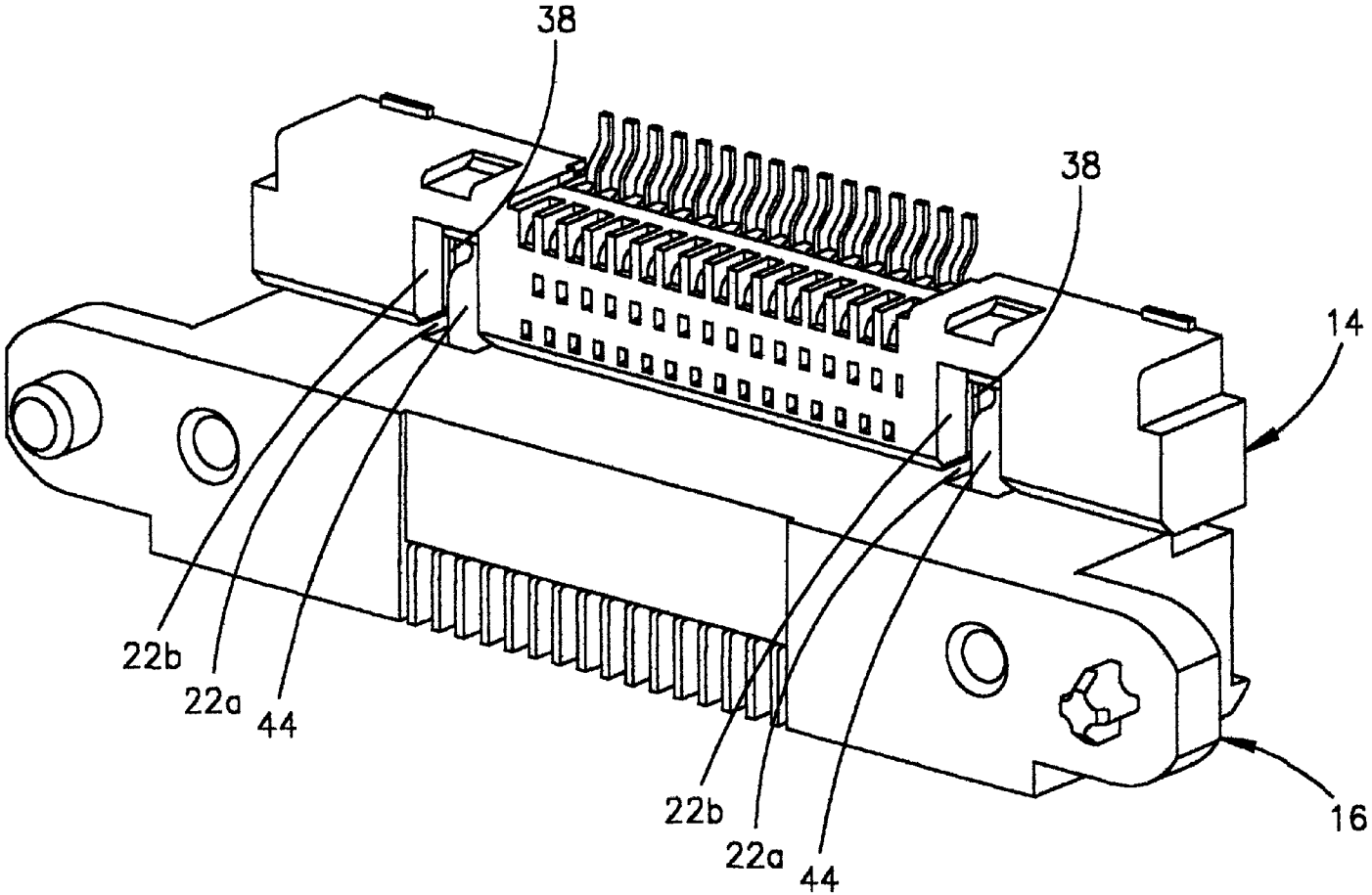
FIG. 3 is a front perspective view of the connectors in mated condition.

Second connector 16 of electrical connector assembly 12 also includes an elongated dielectric body 24 molded of plastic material or the like. The body mounts a plurality of terminals 26 in a parallel linear array. The terminals have contact portions 26*a* for engaging the terminals 20 of first connector 14. A pair of aligning or lead-in posts 28 are molded integrally with body 24 and project upwardly therefrom near opposite ends thereof. The posts have chamfered or angled inside surfaces 28*a* which engage within the first connector 14 above the rear bottom edge 30 (FIG. 2) of first connector 14, the bottom edge 30 corresponding to the bottom of metal latch plate 32, to guide the first connector into proper mating position with the second connector as shown in FIG. 3. In the orientation in the drawings, it can be seen that first connector 14 is mated with second connector 16 in a vertical linear direction as represented by arrows "A". When the two connectors are in mated condition as shown in FIG. 3, terminals 20 and 26 of the respective connectors are interengaged to establish electrical circuits therethrough.

Figure 4:
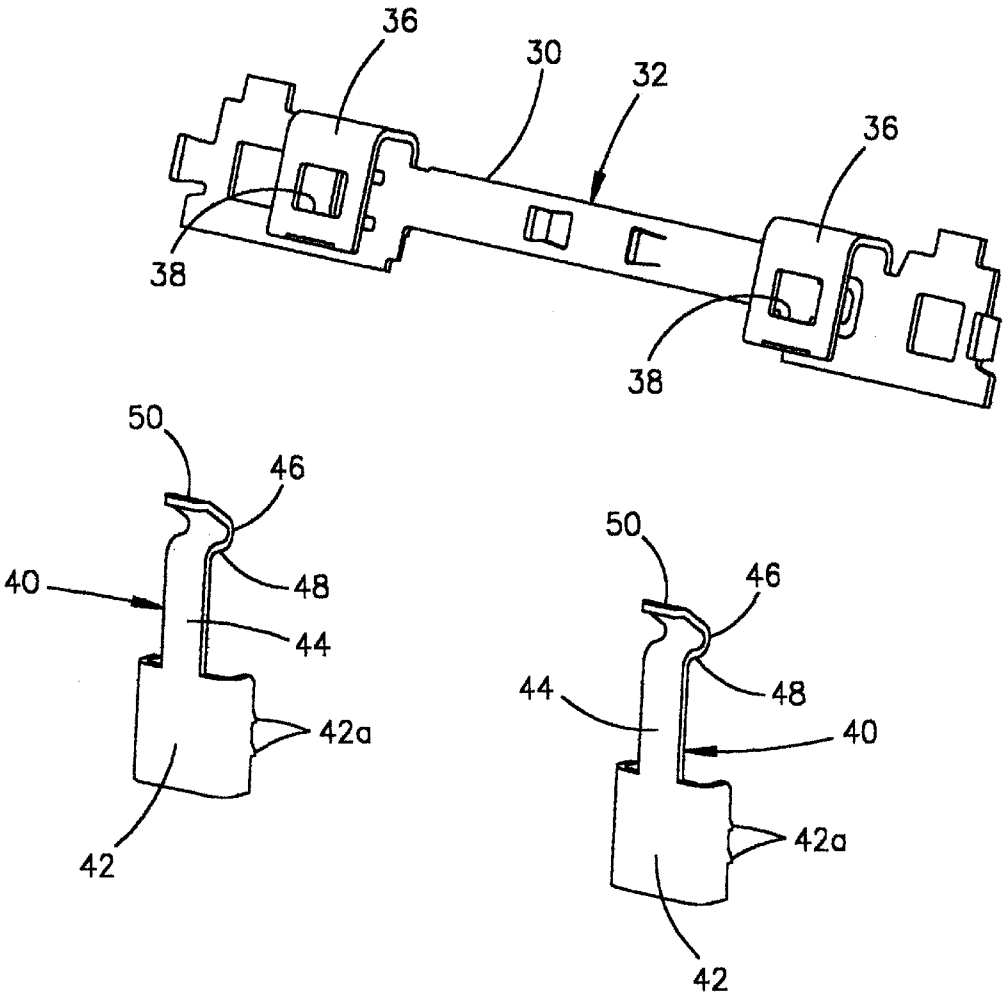
FIG. 4 is a perspective view of the metal latches of the connectors in unmated condition.
Figure 5:
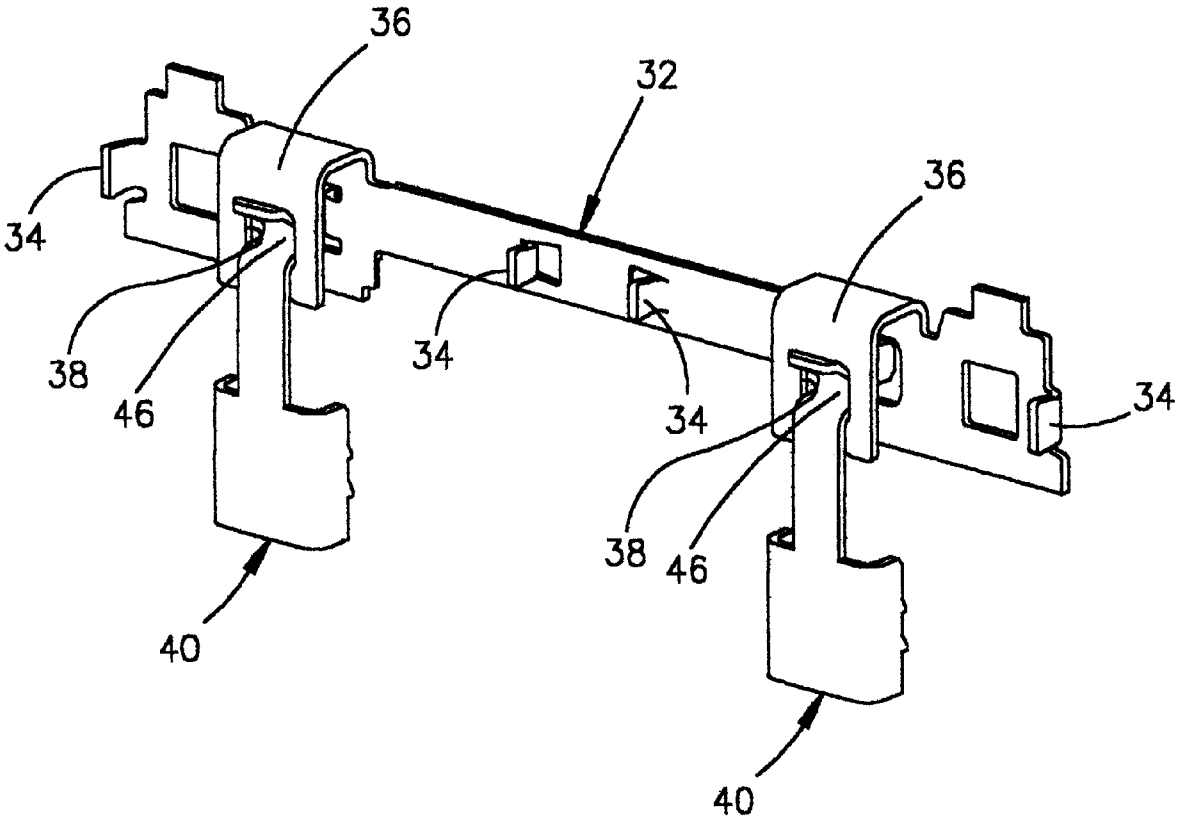
FIG. 5 is a perspective view of the metal latches of the connectors in mated condition.

Referring to FIGS. 4 and 5 in conjunction with FIGS. 1–3, a unique latching system is provided for holding connectors 14 and 16 in their mated condition as shown in FIG. 3, and allowing the connectors to be readily unmated with minimal or zero forces. FIG. 4 shows the latching components of the connectors unmated and corresponding to the positions of the connectors in FIGS. 1 and 2. FIG. 5 shows the latching components in latched condition corresponding to the mated condition of the connectors shown in FIG. 3.

More particularly, a stamped and formed sheet metal latch plate, generally designated 32 (FIGS. 4 and 5), is insert molded to the rear side of molded plastic body 18 of first connector 14 as best seen in FIG. 2. The latch plate has a number of stamped and formed tabs 34 which project inwardly and which are completely overmolded to facilitate holding the latch plate at the rear of connector body 18. A pair of inverted U-shaped portions 36 of the latch plate each includes an opening or stamped hole which defines a pair of locking shoulders 38 spaced longitudinally of the plate. When latch plate 32 is insert molded at the rear side of connector body 18, locking shoulders 38 are located at the back sides of cavities 22 as viewed in FIGS. 1 and 3. In other words, the locking shoulders 38 are located at sides of the cavities diametrically opposite open sides 22*b* of the cavities. The locking shoulders are generally located longitudinally of the connector body to be disposed outside opposite ends of the linear array of terminals 20.

Still referring to FIGS. 4 and 5 in conjunction with FIGS. 1–3, a pair of stamped and formed metal latch components, generally designated 40 (FIGS. 4 and 5), are press fit into appropriate cavities in the underside of body 24 of second connector 16. U-shaped retention sections 42, including teeth 42a, secure latch components 40 within body 24 of the second connector. As clearly seen in FIGS. 1–3, each latch component 40 includes a flexible latch arm 44 which projects upwardly beyond a top surface 24*a* of connector body 24. Each flexible latch arm has a latch hook 46 defining a bottom locking shoulder 48 and a top angled distal end 50. When the two connectors are mated, latch hooks 46 are disposed within the holes in U-shaped portions 36 of latch plate 32, with bottom locking shoulders 48 of the latch hooks in secure locking engagement with locking shoulders 38 of latch plate 32. With both latch plate 32 and latch component 40 being formed from metal, the locking engagement will be not only very strong allowing for many latching and unlatching cycles, but also will allow for a ground connection to be made between the two mating connectors.

Figure 6:
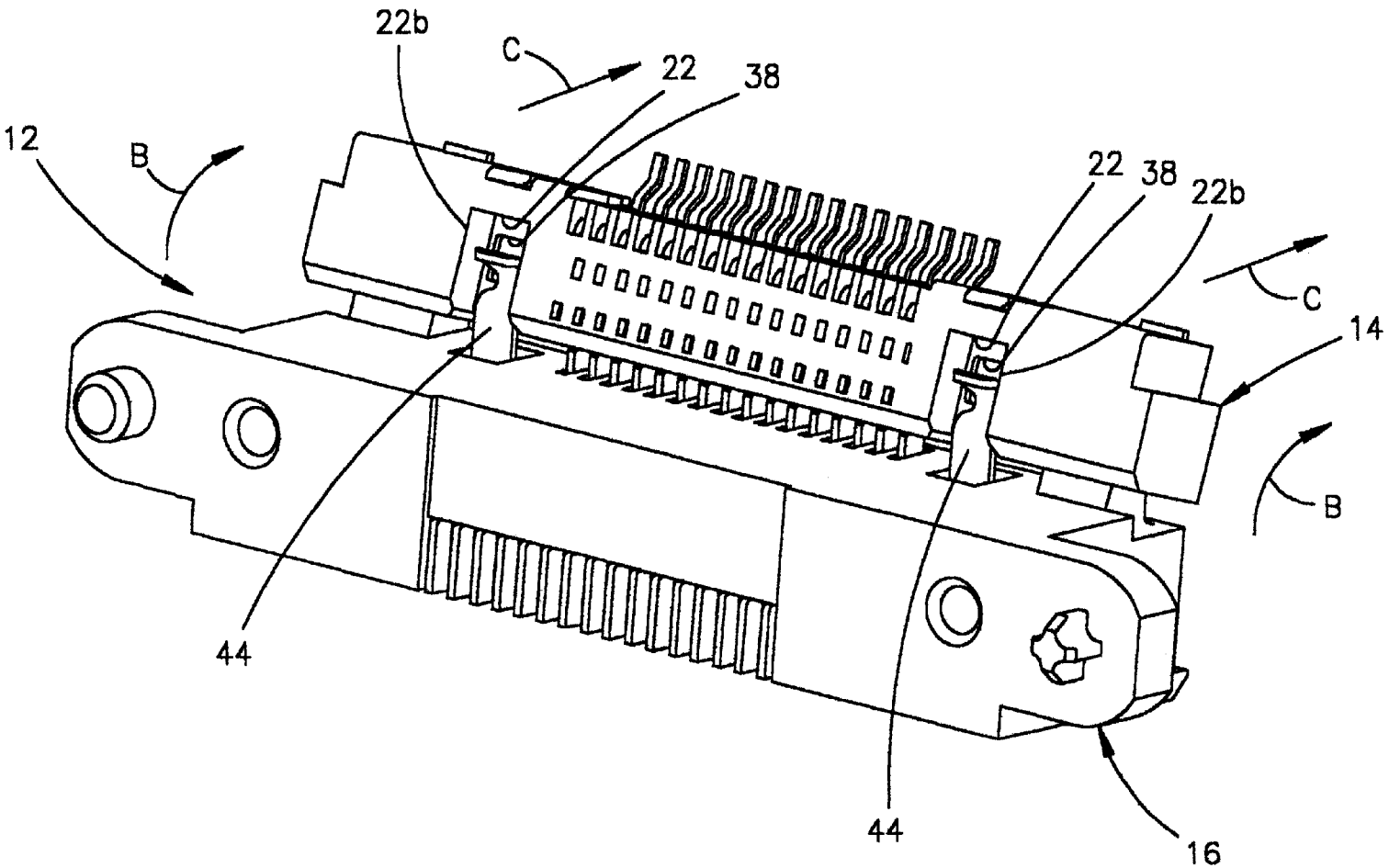
FIG. 6 is a perspective view similar to that of FIG. 3, but showing the top connector being tilted to unmate the connectors.

FIG. 6 shows how the connectors of connector assembly 12 are unmated. Specifically, first connector 14 is rotated or tilted relative to second connector 16 in the direction of arrows "B". Actually, connector 14 is unmated from connector 16 simply by tilting the top of connector 14 in the direction of arrows "C". With cavities 22 being open-sided, as at 22*b,* the latch hooks of flexible latch arms 44 simply are lifted out of the holes in U-shaped portions 36 (FIG. 4) of latch plate 32 to disengage locking shoulders 38 and 48, as described below.

FIGS. 7–10 show locking plate 32 and latch components 40 in sequential schematic illustrations to show the actions of the latching system of the invention during mating and unmating of connectors 14 and 16. The depictions in FIGS. 7–10 are schematic, since the latch plate and latch components are removed from bodies 18 and 24 of first connectors 14 and 16, respectively. These isolations of the latch plate and the latch components would not occur in actual practice, but the depictions in FIGS. 7–10 clearly show the latching and unlatching actions of the latching system.

Figure 7:
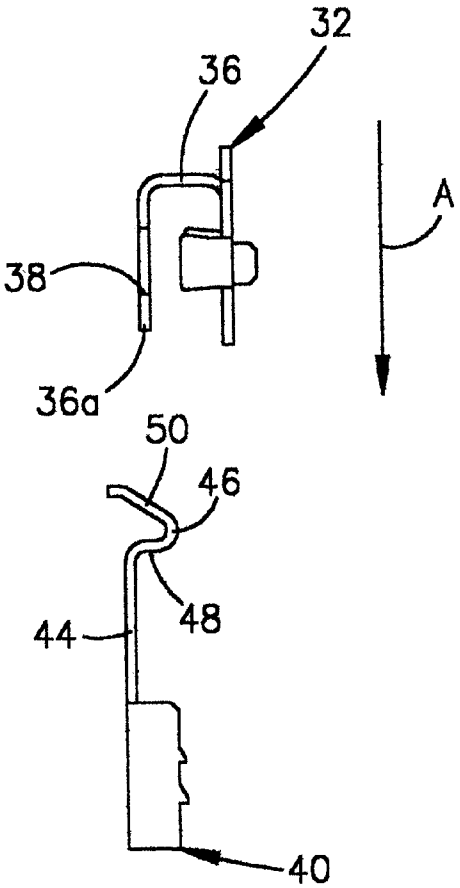

In particular, FIG. 7 shows latch plate 32 in vertical alignment with one of the latch components 40 corresponding to the respective positions of connectors 14 and 16 in FIGS. 1 and 2. As stated above, the connectors are mated in the direction of arrows "A" (FIG. 7). It can be seen that locking shoulders 38 on latch plate 32 are in vertical alignment with locking shoulders 48 on the undersides of latch hooks 46 of flexible latch arms 44. When the connectors are mated in the direction of arrows "A", flexible latch arms 44 move into cavities 22 (FIG. 1) through open bottoms 22*a* thereof.

Figure 8:
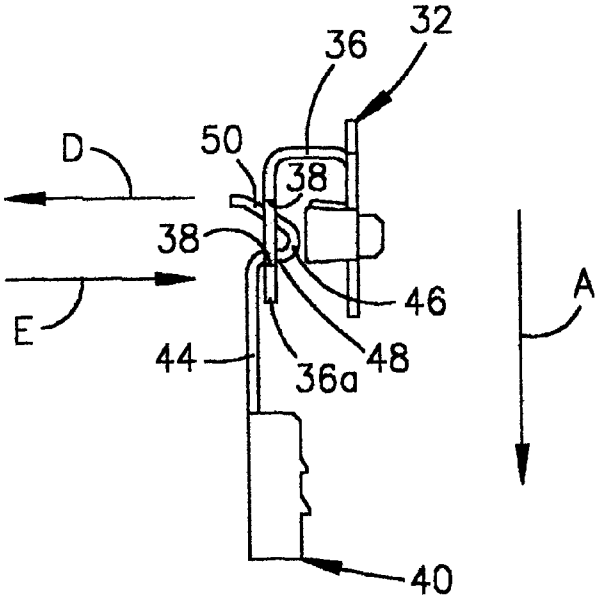
FIGS. 7–10 are side elevational views showing the sequence of latching and unlatching of the metal latches of the connectors.

FIG. 8 shows latch plate 32 and latch components 40 in locking engagement corresponding to the latched condition of connectors 14 and 16 in FIG. 3. It can be seen that a distal end 36*a* of inverted U-shaped portion 36 of latch plate 32 is in direct vertical alignment with angled distal end 50 of flexible latch arm 44. Therefore, when latch plate 32 (i.e., connector 14) is moved in mating direction "A" (FIG. 7), distal end 36*a* of the latch plate will engage angled distal end 50 of the flexible latch arm and bias the latch arm outwardly in the direction of arrow "D" (FIG. 8). When latch hook 46 becomes aligned with locking shoulder 38 in the latch plate, the flexible latch arm will snap back in the direction of arrow "E" whereupon the latch hook enters the hole and interengages locking shoulder 48 on the latch hook with locking shoulder 38 in the hole. The two connectors are now securely latched against movement opposite the mating direction indicated by arrow "A".

Figure 9:
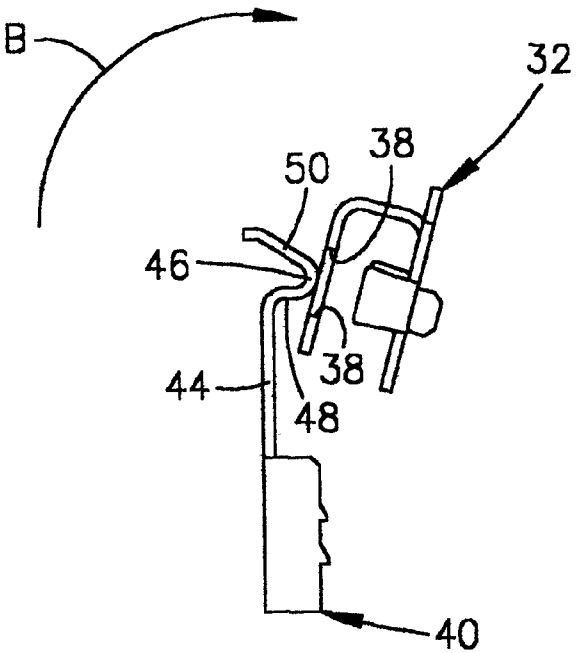

FIG. 9 shows the movement of latch plate 32 relative to latch components 40 when connector 14 is rotated or tilted in the direction of arrow "B" corresponding to the tilting action described above in relation to FIG. 6. When the connectors are relatively tilted, latch hook 46 moves out of the hole which forms locking shoulder 38 and disengages locking shoulders 38 and 48. This unlatching action is accomplished with little or no unlatching forces. As stated above, the relative tilting action of the connectors is allowed because cavities 22 are open-sided, as at 22*b,* to allow flexible latch arms 44 and particularly latch hooks 46 to move sideways out of the cavities away from latch plate 32.

Figure 10:
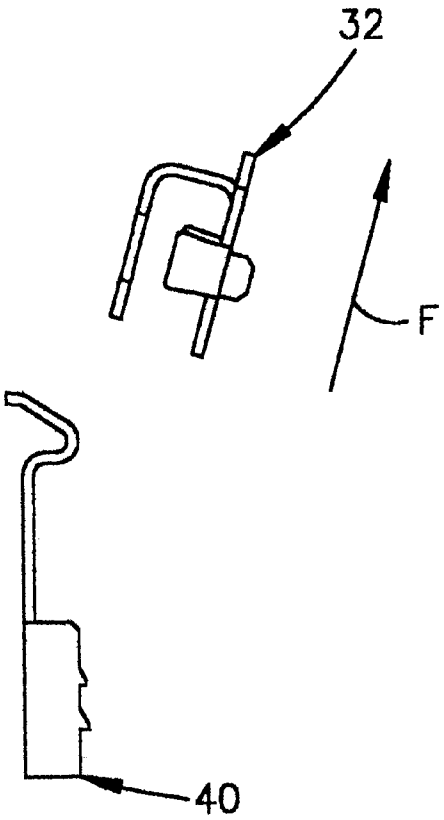

Finally, once connector 14 is tilted relative to connector 16 in the direction of arrow "B", the connectors can be completely separated in the direction of arrow "F" shown in FIG. 10. This free separation is allowed because latch plate 32 has been completely disengaged from latch components 40 in response to the relative tilting action described above.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly, comprising:

a first connector including a body mounting a plurality of terminals, and a locking shoulder on the body;

a second connector including a body mounting a plurality of terminals engageable with the terminals of the first connector, the second connector being mateable with the first connector in a given mating direction;

a flexible latch arm mounted on the body of the second connector and including a latch hook engageable with the locking shoulder of the first connector when the two connectors are mated in said given mating direction; and said locking shoulder being located in an open-sided cavity in the body of the first connector to allow the latch hook to be lifted away from the locking shoulder in response to tilting the first connector relative to the second connector transversely of said given mating direction, said locking shoulder being formed on a metal component insert molded in the body of the first connector.

2. An electrical connector assembly, comprising:

a first connector including a body mounting a plurality of terminals, and a locking shoulder on the body;

a second connector including a body mounting a plurality of terminals engageable with the terminals of the first connector, the second connector being mateable with the first connector in a given mating direction;

a flexible latch arm mounted on the body of the second connector and including a latch hook engageable with the locking shoulder of the first connector when the two connectors are mated in said given mating direction, said flexible latch arm being stamped and formed of sheet metal material mounted on the body of the second connector; and said locking shoulder being located in an open-sided cavity in the body of the first connector to allow the latch hook to be lifted away from the locking shoulder in response to tilting the first connector relative to the second connector transversely of said given mating direction, said locking shoulder being formed on a metal component inserted molded in the body of the first connector.

3. An electrical connector assembly, comprising:

a first connector including a body mounting a plurality of terminals, and a metal latch component insert molded in the body and including a locking shoulder;

a second connector including a body mounting a plurality of terminals engageable with the terminals of the first connector, the second connector being mateable with the first connector in a given mating direction;

a flexible latch arm stamped and formed of sheet metal material and mounted on the body of the second connector, the flexible latch arm including a latch hook engageable with the locking shoulder of the first connector when the two connectors are mated in said given mating direction; and said locking shoulder being located at one side of an open-sided cavity in the body of the first connector, and the cavity being open at a side thereof opposite the locking shoulder to allow the latch hook to move away from the locking shoulder in response to tilting the first connector relative to the second connector transversely of said given mating direction.

4. The electrical connector of claim 3 further including means for aligning the first connector and the second connector in a mating relationship in said given mating direction, said means for aligning designed to allowing the tilting motion of the first connector relative to the second connector.

5. The electrical connector of claim 3 wherein said bodies of the first and second connectors are elongated, and including at least a pair of said locking shoulders and respective flexible latch arms spaced longitudinally of the respective bodies.

6. The electrical connector of claim 5 wherein the terminals of the respective connectors are in elongated arrays, and said pair of locking shoulders and respective flexible latch arms are located outside opposite ends of the elongated arrays of terminals.

7. An electrical connector assembly, comprising:

a first connector including a body mounting a plurality of terminals, and a locking shoulder on the body;

a second connector including a body mounting a plurality of terminals engageable with the terminals of the first connector, the second connector being mateable with the first connector in a given mating direction;

a flexible latch arm mounted on the body of the second connector and including a latch hook engageable with the locking shoulder of the first connector when the two connectors are mated in said given mating direction; and said locking shoulder being located in an open-sided cavity in the body of the first connector to allow the latch hook to be lifted away from the locking shoulder in response to tilting the first connector relative to the second connector transversely of said given mating direction.

8. The electrical connector of claim 7 wherein said locking shoulder is located at one side of said cavity, and the cavity is open at a side thereof opposite the locking shoulder to allow the latch hook to move away from the locking shoulder.

9. The electrical connector of claim 7 wherein said flexible latch arm is stamped and formed of sheet metal material mounted on the body of the second connector.

10. The electrical connector of claim 7 wherein said bodies of the first and second connectors are elongated, and including at least a pair of said locking shoulders and respective flexible latch arms spaced longitudinally of the respective bodies.

11. The electrical connector of claim 10 wherein the terminals of the respective connectors are in elongated arrays, and said pair of locking shoulders and respective flexible latch arms are located outside opposite ends of the elongated arrays of terminals.

* * * * *